US010184301B2

(12) United States Patent
Perry et al.

(10) Patent No.: US 10,184,301 B2
(45) Date of Patent: Jan. 22, 2019

(54) DOWNHOLE DRILLING TOOLS AND CONNECTION SYSTEM FOR SAME

(71) Applicant: APS Technology, Inc., Wallingford, CT (US)

(72) Inventors: Carl Allison Perry, Middletown, CT (US); Guy Daigle, Bristol, CT (US); Daniel E. Burgess, Portland, CT (US)

(73) Assignee: APS Technology, Inc., Wallingford, CT (US)

( * ) Notice: Subject to any disclaimer, the term of this patent is extended or adjusted under 35 U.S.C. 154(b) by 150 days.

(21) Appl. No.: 15/153,579

(22) Filed: May 12, 2016

(65) Prior Publication Data

US 2017/0328137 A1 Nov. 16, 2017

(51) Int. Cl.

| | |
|---|---|
| ***E21B 17/02*** | (2006.01) |
| ***E21B 17/00*** | (2006.01) |
| ***E21B 19/16*** | (2006.01) |
| ***H01R 31/06*** | (2006.01) |
| ***E21B 19/18*** | (2006.01) |
| *E21B 17/042* | (2006.01) |
| *E21B 47/00* | (2012.01) |
| *E21B 47/12* | (2012.01) |

(52) U.S. Cl.
CPC ..... *E21B 17/028* (2013.01); *E21B 17/003* (2013.01); *E21B 19/16* (2013.01); *E21B 19/18* (2013.01); *H01R 31/06* (2013.01); *E21B 17/042* (2013.01); *E21B 47/00* (2013.01); *E21B 47/12* (2013.01)

(58) Field of Classification Search
CPC ..... E21B 17/028; E21B 19/16; E21B 17/003; E21B 47/00; E21B 47/12; E21B 17/042; H01R 31/06
See application file for complete search history.

(56) References Cited

U.S. PATENT DOCUMENTS

| | | | | |
|---|---|---|---|---|
| 2005/0016769 A1* | 1/2005 | Wallace | ..... | H01R 13/523 175/40 |
| 2014/0102807 A1 | 4/2014 | Zhao et al. | | |
| 2015/0041149 A1 | 2/2015 | Deere et al. | | |

OTHER PUBLICATIONS

International Search Report and Written Opinion for PCT/US2017/032402 dated Sep. 19, 2017; 16 pages.

* cited by examiner

*Primary Examiner* — Brad Harcourt
(74) *Attorney, Agent, or Firm* — Offit Kurman, P.A.; Gregory A. Grissett

(57) ABSTRACT

An embodiment includes a downhole tool with first and second modular connectors. The connection modules are configured to aid make-up and assembly and improve stability during use.

30 Claims, 12 Drawing Sheets

DOWNHOLE DRILLING TOOLS AND CONNECTION SYSTEM FOR SAME

TECHNICAL FIELD

The present disclosure relates to downhole tools and a connection system for connecting downhole tools together, and a related drilling system and method.

BACKGROUND

Drilling systems are designed to drill into the earth to target hydrocarbon sources as efficiently as possible. Because of the significant financial investment required to reach and then extract hydrocarbons from the earth, drilling operators are under pressure to drill and reach the target as quickly as possible without compromising the safety of personal operating the drilling system. Typical drilling systems include a rig or derrick, a drill string supported by the rig, and a drill bit coupled to a downstream end of the drill string that is used to drill the well into the earthen formation. Surface motors can apply torque to the drill string via a Kelly or top-drive thereby rotating the drill string and drill bit. Rotation of the drill string causes the drill bit to rotate thereby causing the drill bit to cut into the formation. Downhole or "mud motors" mounted in the drill string are used to rotate the drill bit independent from rotation of the drill string. Drilling fluid or "drilling mud" is pumped downhole through an internal passage of the drill string, through the downhole motor, out of the drill bit and is returned back to the surface through an annular passage defined between the drill string and well wall. Circulation of the drilling fluid removes cuttings from the well, cools the drill bit, and powers the downhole motors. Either or both the surface and the downhole motors can be used during drilling depending on the well plan.

Located near the bit may be one or more sensing modules, such as measure-while-drilling ("MWD") tools, built in a bottom hole assembly (BHA). These tools are typically connected to other similar tools or other subs depending on the design of the bottom hole assembly. The process of connecting these tools together, such as, for example, during make-up, tripping-in, or in the assembly shop offsite, involves matching threaded ends together, and screwing the ends together until required torque level is attained. The American Petroleum Institute (API) provides standards for the threaded ends for both pin and box ends of downhole subs. But connecting threaded ends can be difficult and cumbersome due to worn ends, offset diameters, bends in the housings, or other defects due to tool re-use. MWD and LWD tools may also require electrical connections with adjacent tools if the power supplies, controllers, and communication components are housed elsewhere along the BHA. Thus, provision is made to facilitate electrical and mechanical connections between adjacent tools. When connections are made and the rig is operating, there remains a risk of tool failure at the connection points if the connections are not made according to supplier specifications. Furthermore, operating tools with poor and weak connections can affect tool operability if the electronical connections are compromised during connection of the tools or in use downhole. High pressure and temperature common to the drilling environment further impairs connection stability.

SUMMARY

An embodiment of the present disclosure is a tool system for a drilling operation. The tool system includes a first tool elongate in an axial direction. The first tool includes a first end, a second end spaced from first end along the axial direction, an internal passage that extends along the axial direction and that is configured to permit drilling fluid to pass therethrough, and a first mechanical connector disposed at one of the first and second end ends. The tool system includes a modular connector supported in part by the first tool in the internal passage. The modular connector includes a suspension unit and a first electrical connector that is coupled to the suspension unit. The suspension unit is configured to permit the first electrical connector to move along the axial direction with respect to the first mechanical connector response to a force applied to the first electrical connector. The tool system includes a second tool having a first end, a second end opposed to the first end of the second tool, an internal passage that extends through the second tool, and a second mechanical connector disposed at one of the first and second ends of the second tool. The second mechanical connector is adapted for engagement with the first mechanical connector of the first tool and configured to apply the force to the first electrical connector. The downhole system includes a second electrical connector supported in part by the second tool in the internal passage of the second tool. The second electrical connector is configured to 1) mate with the first electrical connector so as to define an electrical contact between the first and second electrical connectors, and 2) apply the force to the first electrical connector in response to engagement of the second tool with the first tool.

Another embodiment of the present disclosure is a tool. The tool includes a tool body that is elongate in an axial direction. The tool body includes a first end, a second end spaced from the first end in the axial direction, a mechanical connector disposed at one of the first and second ends, and an internal passage that extends along the axial direction and that is configured to permit drilling fluid to pass therethrough. The tool includes a first modular connector in the internal passage and positioned toward the first end. The first modular connector includes a suspension unit and a first electrical connector connected to the suspension unit. The suspension unit is configured to permit the first electrical connector to move relative to the first end along the axial direction in response to force applied the first electrical connector in the axial direction. The tool includes a second modular connector in the internal passage and positioned toward the second end. The second modular connector includes a second electrical connector that is fixed relative to the second end.

Another embodiment of the present disclosure is a method for connecting multiple tools together along a drill string for drilling a borehole in an earthen formation. The method includes the step of positioning a downstream tool that is elongate in an axial direction relative to a borehole of an earthen formation. The downstream tool includes a body, an internal passage that extends through the body, a suspension unit in the internal passage and carried by the body, and a downstream electrical connector supported by the suspension unit. The downstream electrical connector is moveable relative to the housing along the axial direction. The method includes the step of aligning an upstream tool with the downstream tool along the axial direction, such that, an upstream electrical connector of an upper modular connector module supported by a body of the upstream tool is in axial alignment with the downstream electrical connector. The method includes the step of advancing the upstream tool into engagement with the downstream tool in a downstream direction such that the upstream electrical connector mates with the downstream electrical connector, thereby defining an electrical contact between the upstream tool and the downstream tool. The method further includes causing the further advancement of the upstream tool along the downstream direction such that the downstream electrical connector moves in the downstream direction until a terminal surface of the upstream tool abuts a shoulder defined by the downstream tool and the upstream and downstream tools are mechanically coupled together. The suspension unit biases the downstream electrical connector in an upstream direction that is opposite the downstream direction so as to maintain the electrical contact between the mechanically coupled upstream and the downstream tools.

BRIEF DESCRIPTION OF THE DRAWINGS

The foregoing summary, as well as the following detailed description of illustrative embodiments of the present application, will be better understood when read in conjunction with the appended drawings. For purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1:
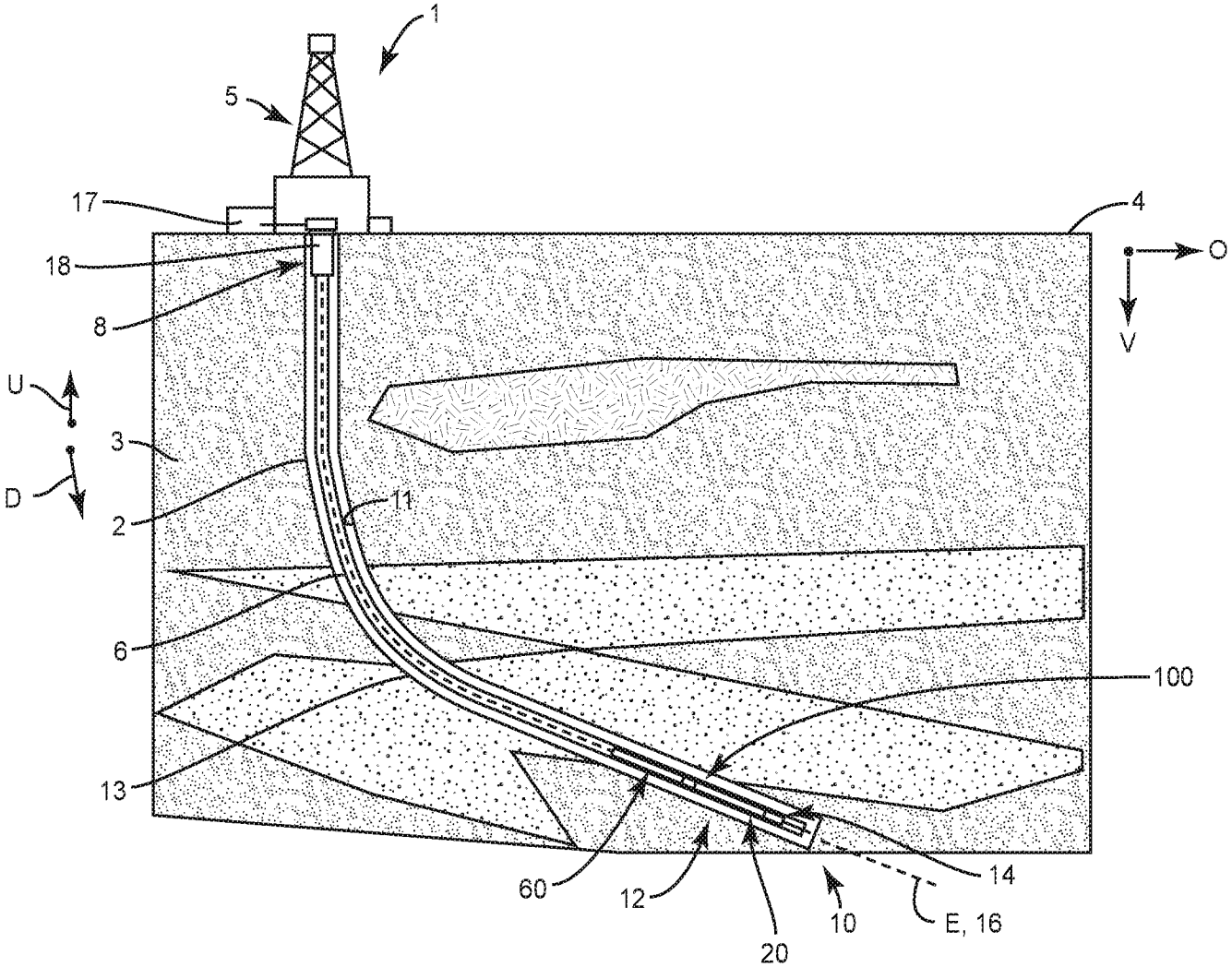
FIG. 1 is a schematic side view of a drilling system according to an embodiment of the present disclosure.

Referring to FIG. 1, embodiments of the present disclosure includes a connection system 100 that can provide reliable electrical and mechanical connections between two or more tools, such as a first tool 20 and a second tool 60 in a drilling system 1. As can be seen in FIG. 1, the drilling system 1 includes a rig or derrick 5 that supports a drill string 6. The drill string 6 includes a bottomhole (BHA) assembly 12 coupled to a drill bit 14. The drill bit 14 is configured to drill a borehole or well 2 into the earthen formation 3 along a vertical direction V and an offset direction O that is offset from or deviated from the vertical direction V. The drilling system 1 can include a surface motor (not shown) located at the surface 4 that applies torque to the drill string 6 via a rotary table or top drive (not shown), and the downhole motor disposed along the drill string 6 and is operably coupled to the drill bit 14. The drilling system 1 is configured to operate in a rotary drilling mode, where the drill string 6 and the drill bit 14 rotate, or a motor mode where the drill string 6 do not rotate but the drill bit does. Operation of the downhole motor causes the drill bit 14 to rotate along with or without rotation of the drill string 6. Accordingly, both the surface motor and the downhole motor can operate during the drilling operation to define the well 2. During the drilling operation, a pump 17 pumps drilling fluid 9 downhole through an internal passage (not numbered) of the drill string 6 out of the drill bit 14 and is returned back to the surface 4 through an annular passage 13 defined between the drill string 6 and well wall 11. The drilling system 1 can include a casing 18 that extends from the surface 4 and into the well 2. The casing 18 can be used to stabilize the formation near the surface. One or more blowout preventers can be disposed at the surface 4 at or near the casing 18.

Continuing with FIG. 1, the drill string 6 is elongated along a longitudinal central axis 16 that is aligned with a well axis E. The drill string 6 further includes an upstream end 8 and a downstream end 10 spaced from the upstream end 8 along the longitudinal central axis 16. A downhole or downstream direction D refers to a direction from the surface 4 toward the downstream end 10 of the drill string 6. Uphole or upstream direction U is opposite to the downhole direction D. Thus, "downhole" and "downstream" refers to a location that is closer to the drill string downstream end 10 than the surface 4, relative to a point of reference. "Uphole" and "upstream" refers to a location that is closer to the surface 4 than the drill sting downstream end 10, relative to a point of reference.

Referring still to FIG. 1, the drilling system 1 can include a control system, a telemetry system, and one or more tools used to obtain data concerning the drilling operation during drilling. The control system can include a surface control system in the form of one or more computing devices and a downhole control system. The telemetry system facilitates communication among the surface control system components and downhole measurement control system. The telemetry system can be a mud-pulse telemetry system, an electromagnetic (EM) telemetry system, an acoustic telemetry system, a wired-pipe telemetry system, or any other communication system suitable for transmitting information between the surface and downhole locations. Exemplary telemetry systems can include transmitters, receivers, and/or transceivers, along with encoders, decoders, and controllers.

Continuing with FIG. 1, a connection system 100 is used to couple adjacent tools 20 and 60 together. The first and second tools 20 and 60 can be any tools or subs that include electrical components, sensing modules used to obtain data concerning the drilling operation, tools or subs, or tools components used to control or impact the drilling operations, such as rotary steerable motors, vibration damping components, and the like. For instance, either or both of the first tool 20 and second tool 60 may be a measurement-while-drilling (MWD) tool configured to obtain drilling data, such as inclination and azimuth. MWD tools include a power source, transmitter (or transceiver) for communication with the telemetry system, a short-hop transceiver in communication with other electronic components of the bottom hole assembly 12, and a controller including a processor and memory. The MWD tool is configured to obtain drilling information indicative of the drilling direction of the drill bit 14. The MWD tool may include a plurality of sensors that can obtain direct measurements of the azimuth and inclination of the drill bit 14. The tools may also include a logging-while-drilling (LWD) tool for use combination with or in lieu of the MWD tool. The tools may include a so-called "triple combo" or "quad combo" tool that includes: a gamma ray measurement module; resistivity measurement module; and neutron porosity, density, sonic, and hole caliper (NPDC) module. Other tools may include a rotary steerable motor (RSM) tool, rotary steerable system (RSS), a rotary pulser, EM tool, a vibration damping system, a PWD tool, an azimuthal gamma tool, a azimuthal resistivity tool, and WOB-TOB-BOB tool, etc.

The connection system 100 is described below with reference to a first tool 20 and a second tool 60. For purposes of describing embodiments of the present disclosure, the first tool 20 is sometimes referred to as an upstream tool 20 and the second tool 60 is referred to as the downstream tool 60. The downstream tool 60 is a tool disposed in a downstream direction D with respect to the upstream tool 20. It should be appreciated that the first tool 20 and the second tool 60 could be any of one of the tools described above, such as MWD tool, LWD tool, triple combo tool, etc. Furthermore, the first tool 20 and the second tool 60 could be an assembly of subs that include the connection modules as describe herein. For instance, a tool could include a connection sub assembly that houses a portion of the connection system 100.

Figure 2:
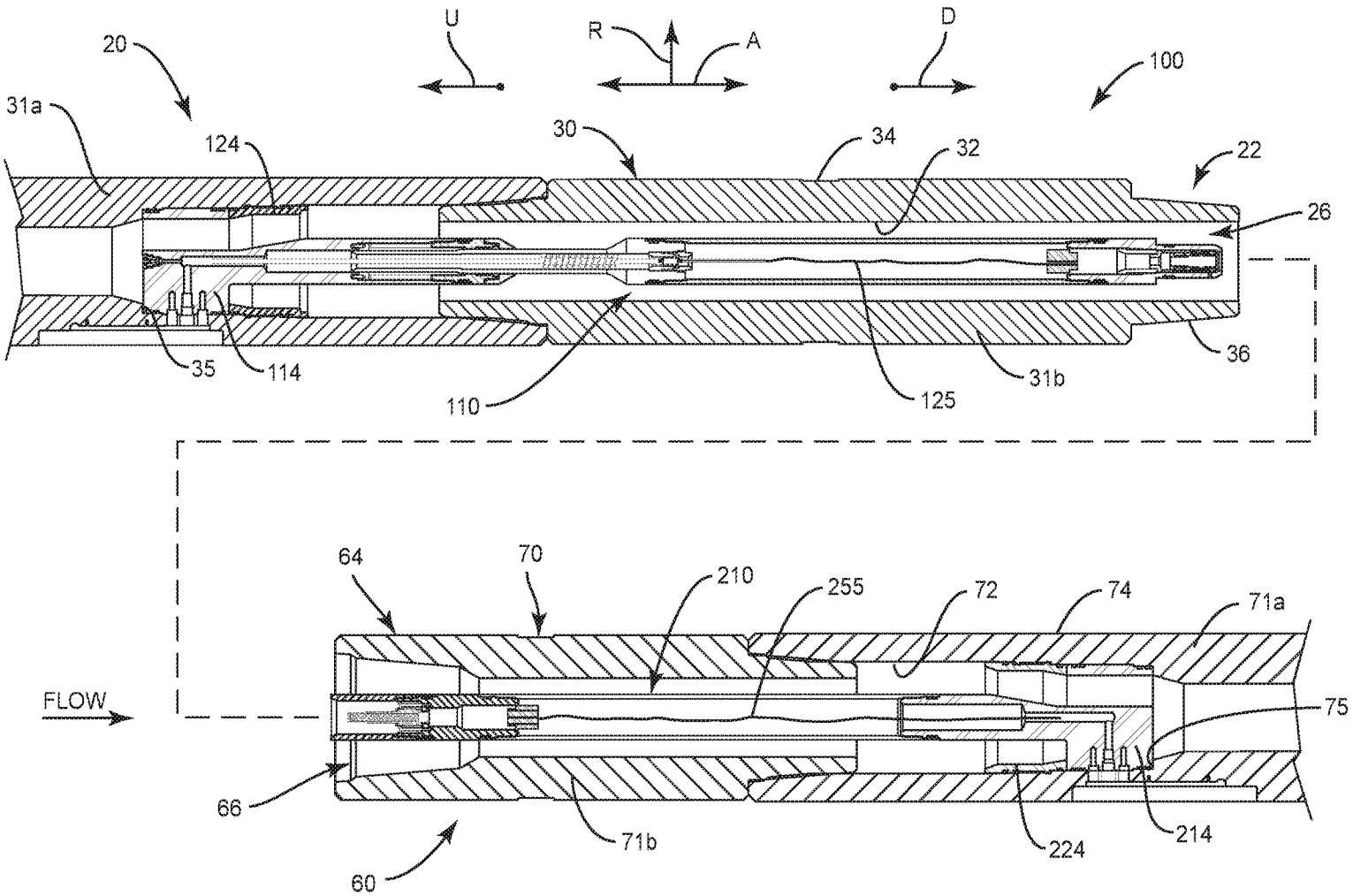
FIG. 2 is an exploded sectional view of first and second tools including a modular connection system according to an embodiment of the present disclosure.
Figure 3:
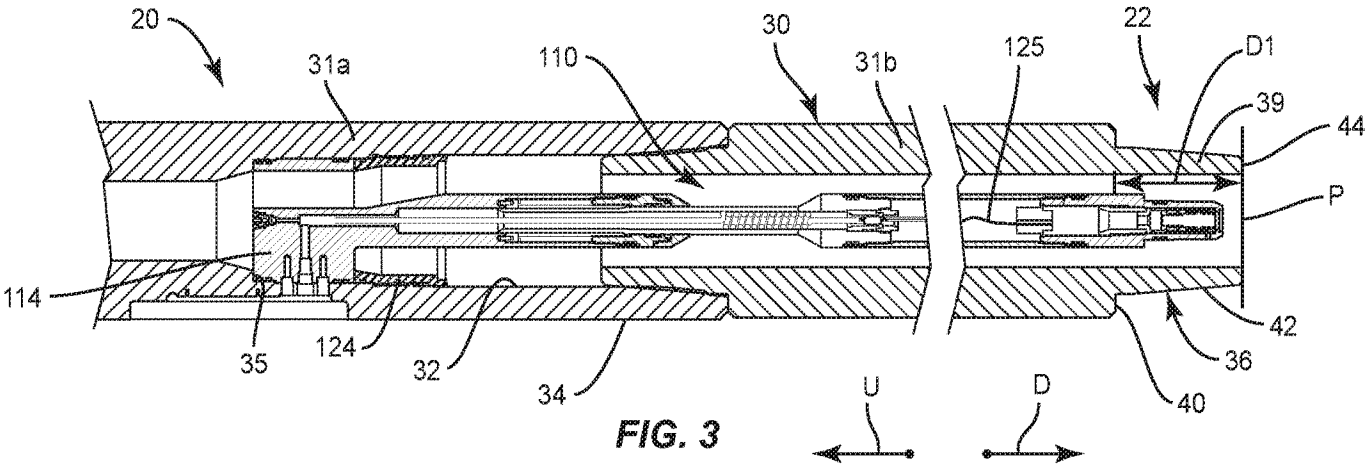
FIG. 3 is a sectional view of the first tool illustrated in FIG. 2.
Figure 4:
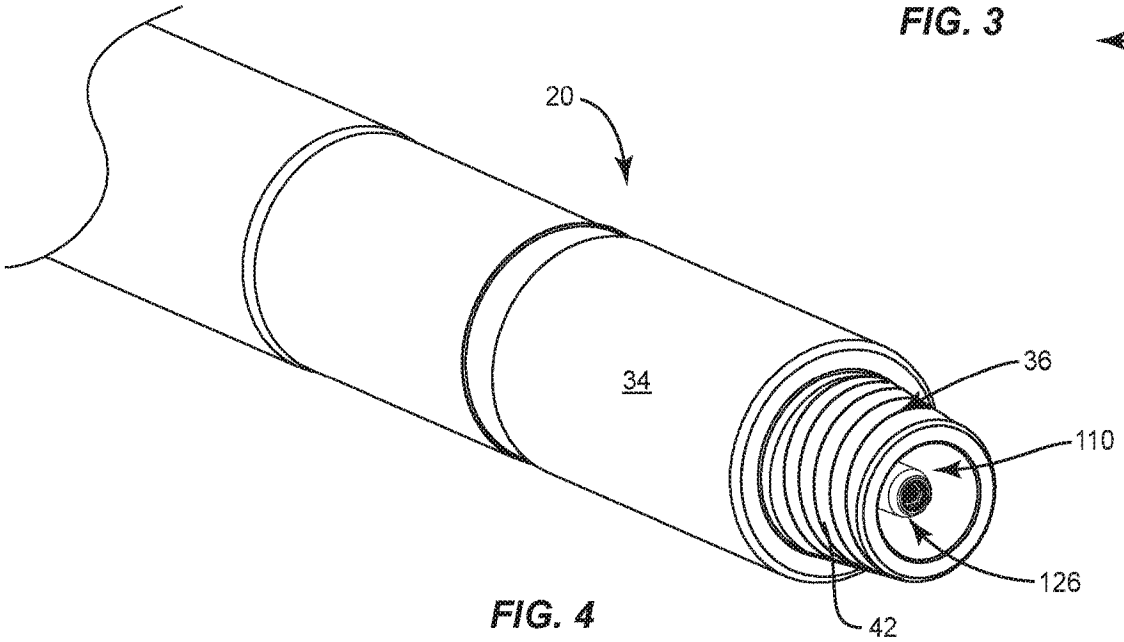
FIG. 4 is a perspective end view of the first tool illustrated in FIG. 2.

FIGS. 2-4 illustrate a first tool or upstream or first tool 20. The upstream tool 20 can be elongate along an axial direction A and include downstream end 22, an upstream end 24 (upstream end 24 not shown in FIGS. 2-4) spaced from the downstream end 22 along the axial direction A. The upstream end 24 (not shown in FIGS. 2-4) can be referred to as the first end of the upstream tool 20 and the downstream end 22 can be referred to as the second end of the upstream tool 20. The upstream tool 20 includes an internal upstream passage 26 that extends along the axial direction A and is configured to permit drilling fluid to pass therethrough. The upstream tool 20 can include an upstream tool body 30 that extends from the downstream end 22 to the upstream end 24 along the axial direction A. The upstream tool body 30 defines an inner surface 32 and an outer surface 34 opposed to the inner surface 32 along a radial direction R that is perpendicular to the axial direction A. A portion of the connection system 100, such as the first modular connector 110, is disposed in the internal upstream passage 26 as further described below. The upstream tool 20, for example the upstream tool body 30, can include multiple subs 31*a* and 31*b* connected together end-to-end to define a downstream portion of the upstream tool 20. Although two subs 31*a* and 31*b* are illustrated in FIG. 2 to define the downstream portion of the upstream tool 20, more subs may be used. Alternatively, the upstream tool body 30 can be a single piece or a single sub tool. Each sub 31*a* and 31*b* of the upstream tool 20 can include "pin" or "pin box" ends as is known in the art. Sub 31*a* includes an inner shoulder 35 used to help secure components of the tool in place, as will be explained further below.

Continuing with FIGS. 2-4, the upstream tool 20 includes a first mechanical connector 36 and a second mechanical connector 38 at the downstream end 22 and upstream end 24, respectively. The first (or downstream) mechanical connector 36 is illustrated as a pin type connector. The second (or upstream) mechanical connector 38 (not shown) can be configured as a pin or box connecter. The first mechanical connector 36 includes an engagement body 39 that includes a shoulder 40, an external coupling surface 42, and a terminal surface 44 spaced apart relative to the shoulder 40 a distance D/l. The external coupling surface 42 extends from the shoulder 40 to the terminal surface 44 and is generally tapered toward central axis that is aligned with axial direction A. The distance D/l, however, extends from a surface defining the shoulder 40 to a plane P that is aligned with terminal surface 44 and that is perpendicular to the axial direction A. The distance D/I is thus parallel to the axial direction A. The coupling surface 42 can include threads (not illustrated in the figures) formed in accordance with API standards for threaded connections.

Figure 7:
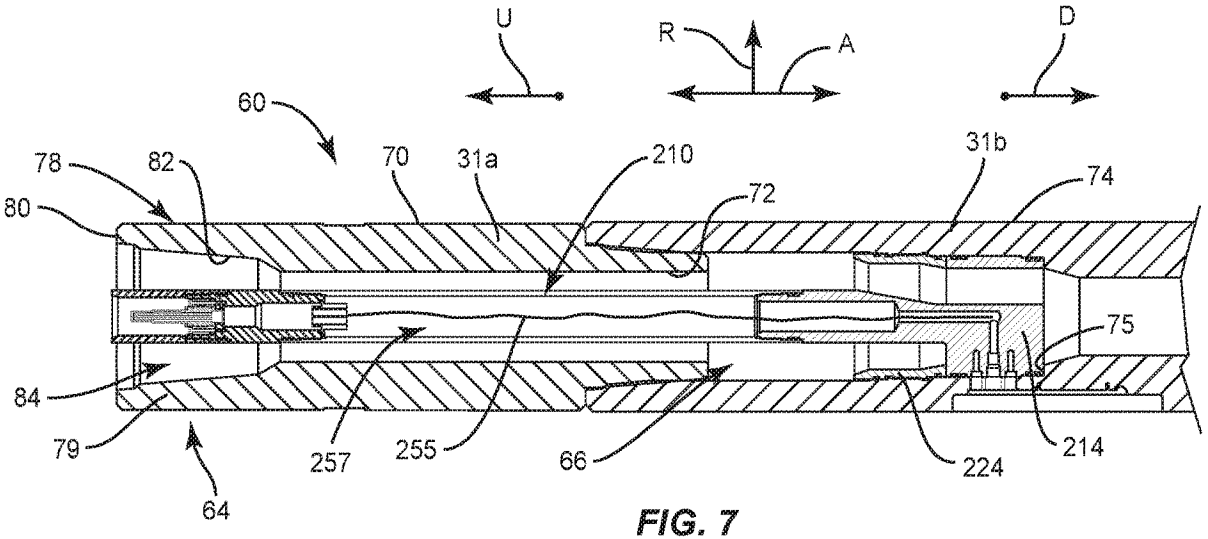
FIG. 7 is a sectional view of the second tool illustrated in FIG. 2.
Figure 8:
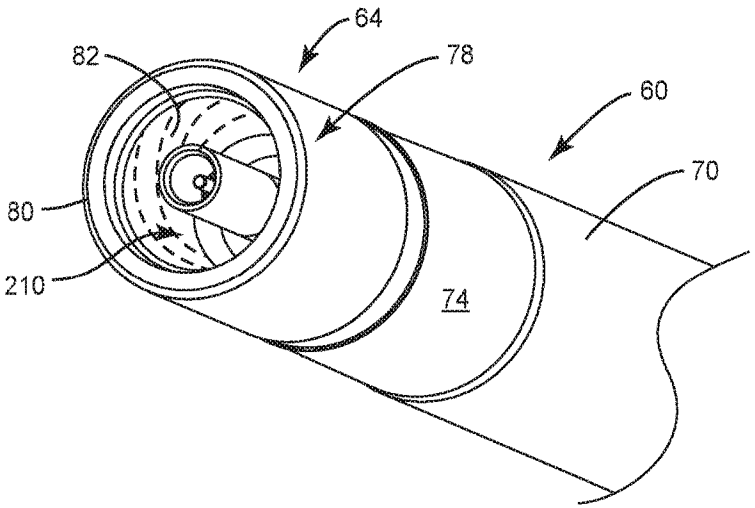
FIG. 8 is an end perspective view of the second tool illustrated in FIG. 2.

FIGS. 2, 7 and 8 illustrates the downstream tool 60. In accordance with the illustrated embodiment, the downstream tool 60 can be elongate along the axial direction A. The downstream tool 60 includes a downstream end 62 (not shown) and an upstream end 64 spaced from the downstream end 62 along the axial direction A. The upstream end 64 can be referred to as the first end of the downstream tool 60, and the downstream end 62 can be referred to as the second end of the downstream tool 60. The downstream tool 60 includes an internal downstream passage 66 that extends along the axial direction A and is configured to permit drilling fluid to pass therethrough. When the downstream tool 60 is coupled to the upstream tool 20, the downstream passage 26 and upstream passage 66 are in alignment and together define a portion of the drill string internal passage. A portion of the connection system 100, such as the downstream modular connector 210, is disposed in the internal downstream passage 66 as further described below. The downstream tool 60 can include a downstream tool body 70 that extends from upstream end 64 to the downstream end 62 (not shown) along the axial direction A. The downstream tool body 70 defines an inner surface 72 and an outer surface 74 opposite the inner surface 72 along the radial direction R. The downstream tool body 70 can be formed from multiple subs 71*a* and 71*b* connected together end-to-end to define an upstream portion of the downstream tool 60. Although two subs 71*a* and 71*b* are illustrated in FIG. 2 to define the upstream portion of the downstream tool 60, more subs may be used. Alternatively, the downstream tool body 70 can be a single piece or single sub tool. Each sub 71*a*, 71*b* of the downstream tool 60 can include pin connectors and box connectors as is known in the art. Sub 71*b* includes an inner shoulder 75 used to help secure components of the tool in place as further explained below.

Continuing with FIGS. 2, 7 and 8, the downstream tool 60 includes a first mechanical connector 76 (not shown) at the downstream end 62 (not shown) and a second mechanical connector 78 at the upstream end 64. The second (or upstream) mechanical connector 78 can be configured as box-type connecter as shown. The downstream connector is not shown but can be configured as a pin or box connector. The upstream mechanical connector 78 includes an engagement body 79 that defines a terminal surface 80 and an internal coupling surface 82. The internal surface 82 defines a cavity 84 that extends from the terminal surface 80 to a narrowed portion of the passage. The internal coupling surface 82 is generally tapered toward a tool centerline. The internal coupling surface 82 includes threads that threadably engage the threads along the external coupling surface 42 (see FIG. 3) of the upstream tool 20. The mechanical connector 78 is formed in accordance with API standards for threaded connectors. In alternative embodiments, the mechanical connector 78 can be configured as pin connector. In such an alternative embodiment, the first mechanical connector 36 of the upstream tool would be configured as a pin connector.

Referring FIG. 2, the connection system 100 can electrically couple the upstream tool 20 and the downstream tool 60 together. The connection system 100 includes a first modular connector 110 housed in one of the first and second tools 20 and 60 and a second modular connector 210 housed in the other of the first and second tools 20 and 60. In accordance with the illustrated embodiment, the first modular connector 110 is located in upstream tool 20 and can be referred to as an upstream modular connector 110. The first modular connector 110 is supported by the upstream tool 20 in the internal upstream passage 26 via a feed-through centralizer 114. The first modular connector 110 is secured in place with a threaded nut 124 and inner shoulder 35 (FIG. 3). The centralizer and threaded nut 124 are further described below. As illustrated, the first modular connector 110 is disposed toward the downstream end 22 of upstream tool 20. The second modular connector 210 is located in the downstream tool 60 and can be referred to as a second modular connector 210. As illustrated, the downstream modular connector 210 is supported by the downstream tool 60 in the internal downstream passage 66 via a feed-through centralizer 214. The second modular connector 210 is secured in place with 2 and inner shoulder 75 (FIG. 7). The centralizer 214 and threaded nut 224 are further described below. The second modular connector 210 is disposed toward the upstream end 64 of the downstream tool 60 so as to engage the first modular connector 110 during a connection event.

Figure 5A:
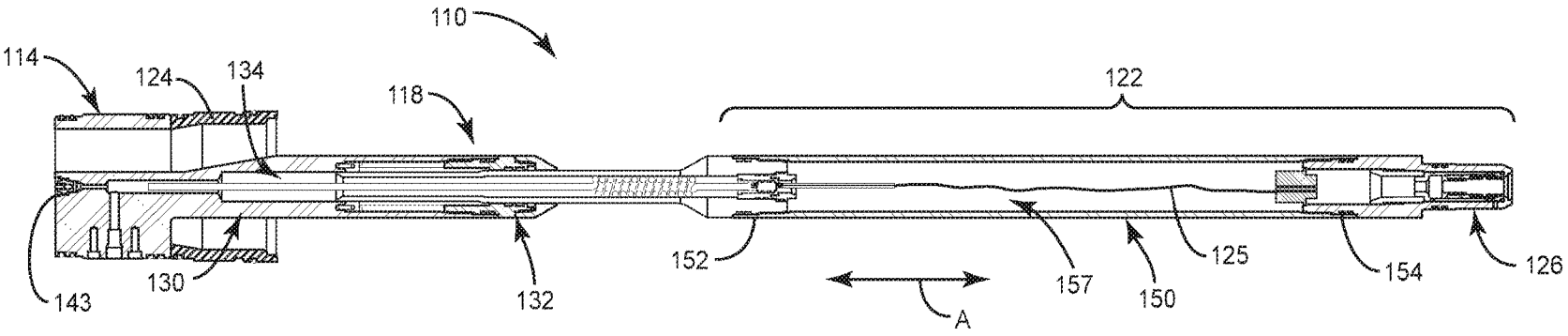
FIG. 5A is a sectional view of a first portion of the connection system illustrated in FIGS. 2 to 4.
Figure 5B:
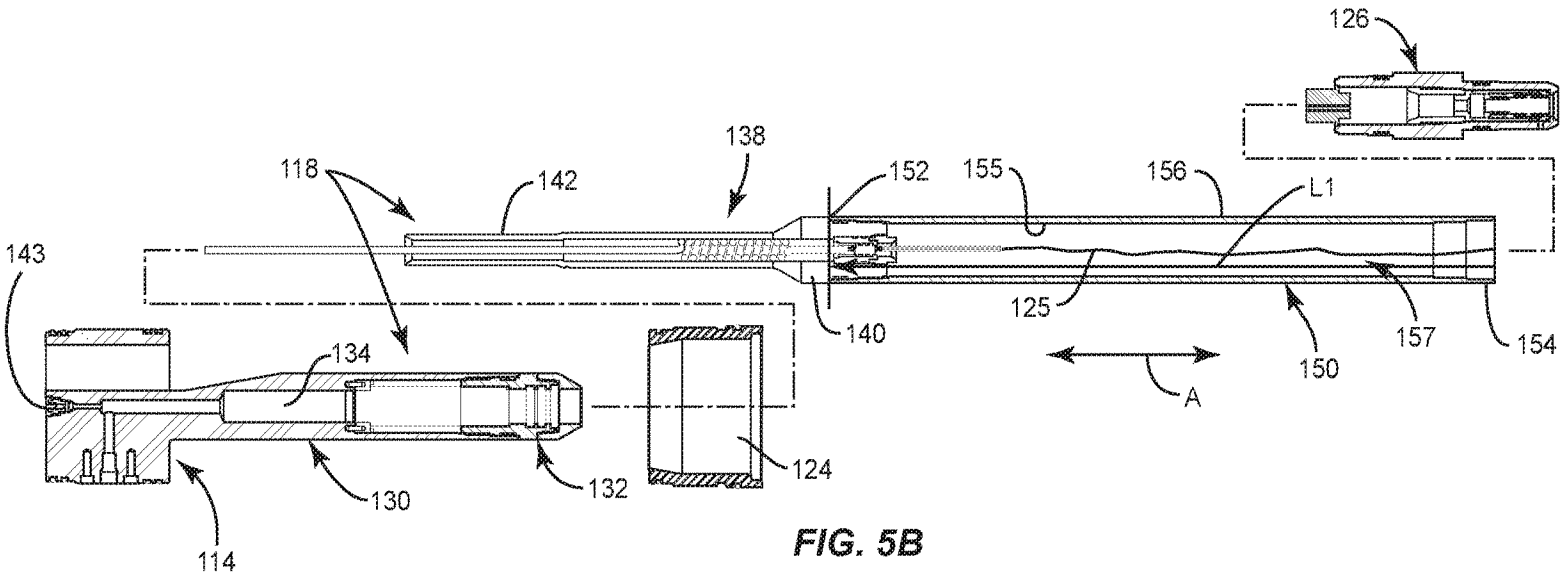
FIG. 5B is a sectional exploded view of the first portion of the connection system illustrated in FIG. 5A.

Turning to FIGS. 3-5B, the first modular connector 110 is disposed in the upstream tool 20 toward the downstream end 22. Referring to FIGS. 5A and 5B, the first modular connector 110 includes a feed-through centralizer 114, a suspension unit 118 fixed to the feed-through centralizer 114, a first connection assembly 122 coupled to the suspension unit 118, and a threaded nut 124. The first connection assembly 122 includes the first electrical connector 126. As best shown in FIG. 3, the first electrical connector 126 is aligned with the first mechanical connector 36 along the axial direction A. The first electrical connector 126 is configured to define an electrical connection with the second modular connector 210.

Referring to FIGS. 3-5B, the feed-through centralizer 114 is secured to the inner surface 32 of the upstream tool 20 with the threaded nut 124. The threaded nut 124 is threaded to the inner surface 32 of the upstream tool 20. The threaded nut 124 clamps the feed-through centralizer 114 against the inner shoulder 35, thereby securing the feed-through centralizer 114 to the first tool 20. In use, as internal pressure increases, the threaded nut 124 maintains the feed-through centralizer 114 in position despite forces acting against the connection assembly and suspension unit in the first modular connector 110 as described above. The feed-through centralizer 114 is configured to position the first modular connector 110 at about the centerline of the upstream tool 20 while allowing drilling fluid to pass along the first modular connector 110 in the passage.

Continuing with 3, 5A and 5B, the suspension unit 118 is supported by the upstream tool 20 via the feed-through centralizer 114. The suspension unit 118 includes a housing 130 that extends from the feed-through centralizer 114 along axial direction A. The housing 130 includes a seal assembly 132, which has a sleeve a cap, and a nut seal. The sleeve, cap, and nut seal are not numbered. The housing 130 and seal assembly 132 define a sealed chamber 134 filled with a gas or liquid at a defined pressure, such as standard pressure. In the context, the word "sealed" means substantially sealed in accordance with manufacturing tolerances and the like such that chamber may not be a perfectly sealed chamber. The suspension unit 118 includes a piston 138 that is exposed to the chamber 134 and extends out from the chamber 134 and housing 130 along the axial direction A. The piston 138 is moveable with respect to the housing 130 and seal assembly 132. The piston 138 includes a support body 140 and elongate shaft 142 that extends relative to the support body 140. The support body 140 is fixed to the connection housing 150 as further described below. Gas in the chamber 134 is pressurized to a level that is higher than standard pressure. When the first modular connector 110 and suspension unit 118 is exposed to standard pressure, the piston 138 is biased toward the downstream end 22 of the upstream tool 20, as shown in FIGS. 2 and 3. A valve 143 housed in the feed-through centralizer 114 is in flow communication with the chamber 134 and can be used to selectively adjust the pressure in chamber 134 during assembly of the upstream tool 20.

In an alternative embodiment, the suspension unit can be configured to operate with a mechanical biasing member. In accordance with the alternative embodiment, the suspension unit includes a suspension housing 130, a mechanical biasing member, and a piston 138 that is operable to move in the axial direction relative to the suspension housing 130. The mechanical biasing member can be a spring that is adapted to bias the piston 138 toward the 22 of the upstream tool 20.

Continuing with FIGS. 5A and 5B, the connection assembly 122 includes a connection housing150 and the first electrical connector 126. The connection housing 150 includes a tubular body with a first end 152, a second end 154 opposed to the first end 152, an inner surface 155, an opposed outer surface 156 that faces the inner surface of the upstream tool body 30, and a cavity 157 that extends along the inner surface 155. The cavity 157 includes wires 125 and other components. The connection housing 150 defines a length L1 that extends from the first end 152 to the second end 154 along the axial direction A. The first end 152 of the housing 150 is coupled to the piston support body 140 while the second end 154 is fixed to the first electrical connector 126. The connection housing 150 is sized and configured so that the first electrical connector 126 is disposed proximate the downstream end 22 of the upstream tool 20 prior to connecting the first and second tools 20 and 60 together. Furthermore, the connection housing 150 is fixed to the piston 138 via the support body 140 such that the connection housing 150 is moveable along with the piston 138. Accordingly, the first electrical connector 126 is also moveable together with piston 138 along the axial direction A.

Continuing with FIGS. 5A and 5B, the connection housing 150 can be formed of a single part or multiple parts as needed. Furthermore, during assembly in the shop or at the rig-site, the connection housing 150 can be cut and its length L1 shortened, and reattached to the piston 138 and first electrical connector 126 to accommodate needed spacing adjustments if the mechanical connector 36 of the upstream tool 20 is worn or needs to be refurbished and tool length changed from what is specified in the BHA design and well plan. The ability to shorten the length of the connection housing 150 provides for operational flexibility at the rig-site and improves the efficiency of make-up or break-out operations.

Figure 6:
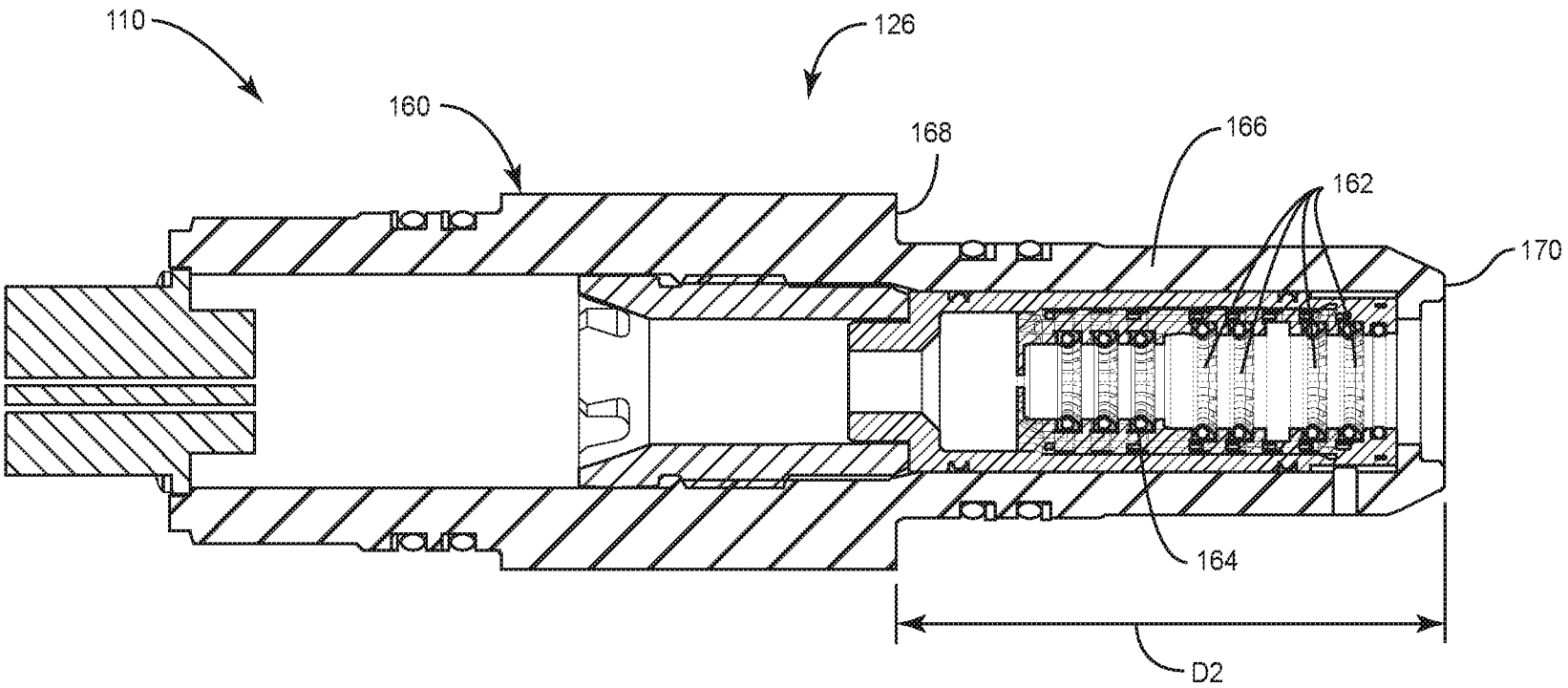
FIG. 6 is a detailed sectional view of an electrical connector according to an embodiment of the present disclosure.

FIG. 6 illustrates the first electrical connector 126 according to an embodiment of the present disclosure. The first electrical connector 126 includes a connector body 160 and a first conductive element 162 disposed along grooves defined by an inner surface 164 of the connector body 160. While a single first conductive element is described, it should be appreciated that more than one conductive element is disposed along the inner surface 164 of the connector body 160. The first conductive element 162 is also referred to herein as a female conductive element. The female conductive element 162 is an annular shape and can define female electrical connector. The female conductive element 162 defines a cylindrical path that receives the male conductive element 262 (see FIG. 10) of the second modular connector 210 when the first and second tools 20 and 60 are coupled together. In one preferred example, the female conductive element 162 can be a canted spring formed of conductive materials. The connector body 160 also includes a stop surface 168 that is perpendicular to the axial direction A, a terminal surface 170, and a wall 166 that extends from stop surface 168 to terminate at the terminal surface 170. The terminal surface 170 is spaced from the stop surface 168 a distance D2 along the axial direction A. The D2 represents the travel distance required for the first electrical connector 126 and the second electrical connector 226 to be fully seated with respect to each other. When even partially or fully seated, the first electrical connector 126 and the second electrical connector 226 define the intended electrical contact between the first tool 20 and second tool 60. The travel distance D2 is less than the distance D1 (FIG. 12A) which permits full travel and seating of the first electrical connector 126 and second electrical connector 226 before downstream tool 60 is fully seated against the shoulder 40 of the upstream tool 20.

Figure 9A:
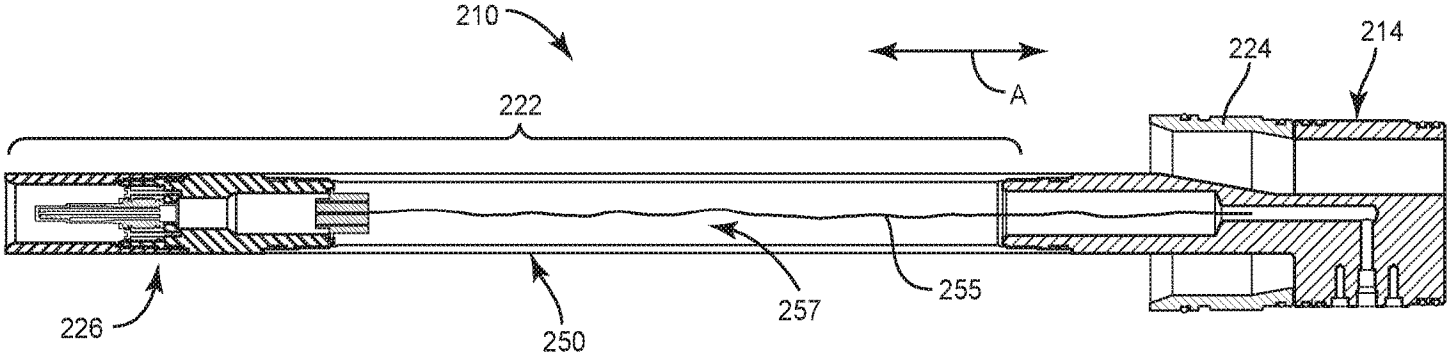
FIG. 9A is a sectional view of a second portion of the connection system illustrated in FIGS. 7 and 8.
Figure 9B:
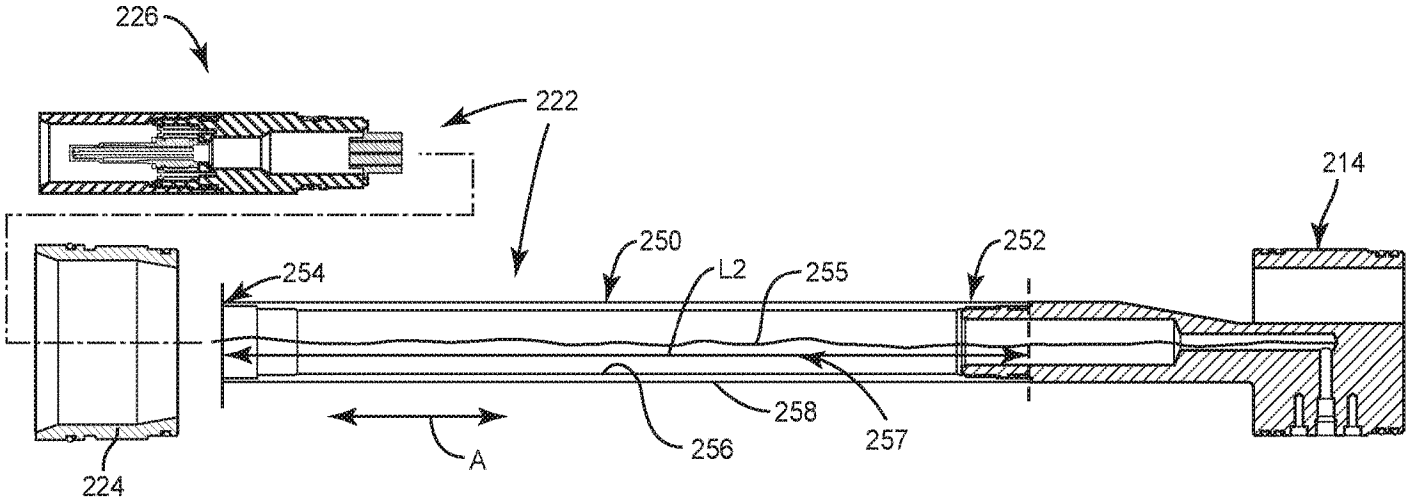
FIG. 9B is a sectional exploded view of the second portion of the connection system illustrated in FIG. 9A.

Turning now to FIGS. 7-9B, the downstream tool 60 includes the second modular connector 210 supported along the inner downstream passage 66 of downstream tool 60. The second modular connector 210 is disposed toward (e.g. proximate) the upstream end 64 of the downstream tool 60. As can be seen in FIGS. 9A and 9B, the second modular connector 210 includes a feed-through centralizer 214, a second connection assembly 222 fixed to the feed-through centralizer 214, and a threaded nut 224. The second connection assembly 222 includes the second electrical connector 226 aligned with the second or upstream mechanical connector 78 (FIG. 8). The second electrical connector 226 is configured to be coupled to the first electrical connector 126 of the first modular connector 110. The threaded nut 224 is threaded to the inner surface 72 of the downstream tool 60. The threaded nut 224 clamps the feed-through centralizer 214 against the shoulder 75, thereby securing the feed-through centralizer 214 to the downstream tool 60. In use, as internal pressure increases, the threaded nut 224 maintains the feed through centralizer in position despite forces acting against the connection assembly and suspension unit in the first modular connector 110 as described above. The feed-through centralizer 214 is similar to the feed-through centralizer 214 described above with respect to the first modular connector 110.

Referring FIGS. 7, 9A, and 9B, the second connection assembly 222 includes a connection housing 250 and the second electrical connector 226. The connection housing 250 is sized and configured so that the second electrical connector 226 is disposed proximate the upstream end 64 of the downstream tool 60. The connection housing 250 includes a tubular body with a first end 252, second end 254 opposed to the first end 252, an inner surface 256, an opposed outer surface 258 that faces the inner surface 72 of the downstream tool body 70, and a cavity 257 extends along the inner surface 256. The cavity 257 can house wires 255 and other components. The connection housing 250 defines a length L2 that extends from the first end 252 to the second end 254 along the axial direction A. The first end 252 of the connection housing 250 is fixed to the feed-through centralizer 214. The second electrical connector 226 is coupled to the second end 254 of the housing 250 and extends from housing 250 toward the upstream end 64 (FIG. 7). As illustrated, the connection housing 250 can be formed from multiple parts or a single monolithic part. Furthermore, during assembly in the shop or at the rig-site, the housing 250 can be cut and its length L2 shortened and reattached to feed-through centralizer 214 and second electrical connector 226 to accommodate needed spacing adjustments if the mechanical connector 78 of the upstream tool 60 is worn or needs to be refurbished and overall tool length changed from what is specified in the BHA design and well plan. This feature also provides for operational flexibility at the rig-site and improves the efficiency of make-up or break-out operations.

Figure 10:
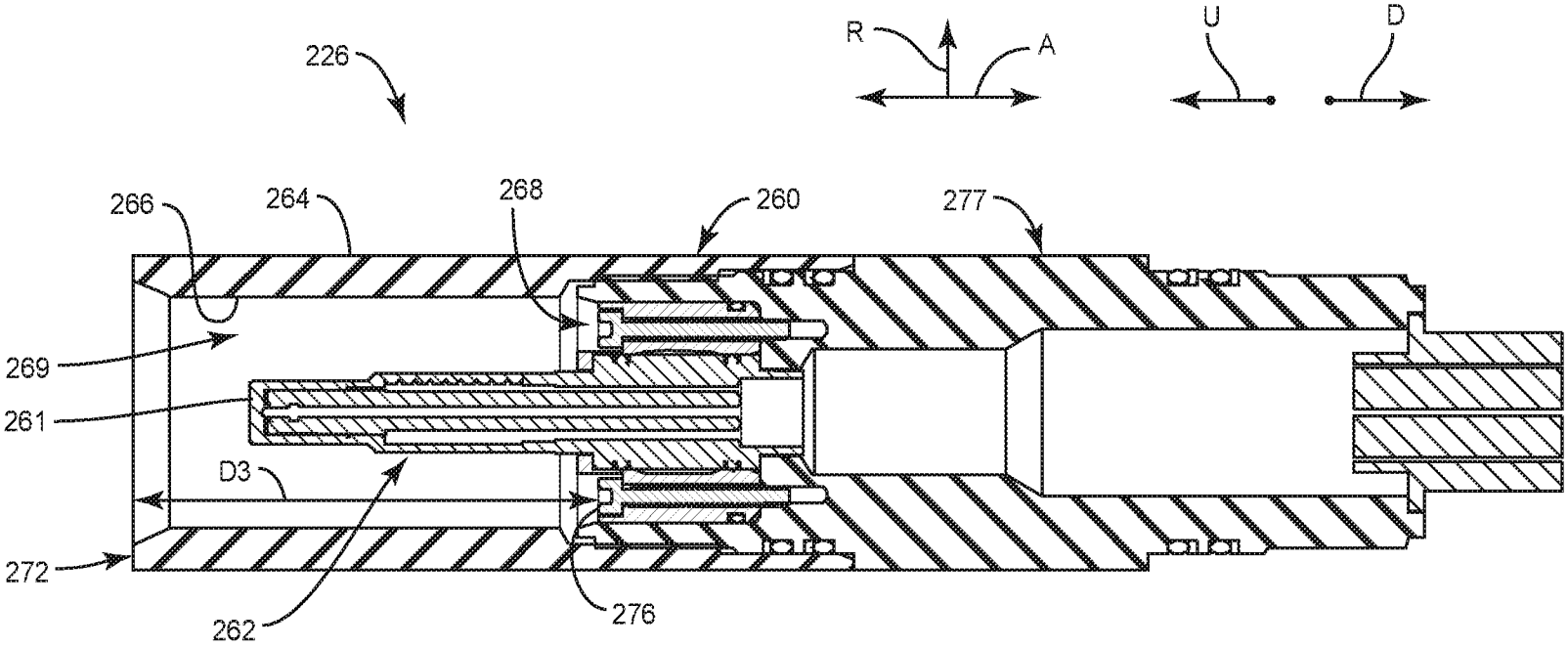
FIG. 10 is a detailed sectional view of an electrical connector according to an embodiment of the present disclosure as shown in FIG. 9A.

Turning to FIG. 10, the second electrical connector 226 includes a connector body 260, a housing 277, and a second conductive element 262. The second connector body 260 includes an outward surface 264 and an inner surface 266 spaced inwardly with respect to the outward surface 264. The housing 277 is coupled to the inner surface 266. A hub 268 is coupled to an inner surface of the housing 277. The hub 268 supports the second conductive element 262. The second conductive element 262 is configured as multiple electric contacts circumferentially disposed around a linear rod-shaped body. While a single, second conductive element is described, it should be appreciated that the second electrical connector can include a plurality of conductive elements. The conductive element 262 can be referred to as the male conductive element or male connector. The second conductive element 262 is sized to be received by the cylindrical path defined by the female electrical conductive element 162. Furthermore, the hub 268 positions the second conductive element 262 in an inward spaced relation with respect to the inner surface 266 of the body 260 along the radial direction R so as to define an annular void 269. The annular void 269 is sized to receive the wall 166 of the first electrical connector 126 while the male conductive element 262 is in slidable contact with the female connector element 162 of the first electrical connector 126 (see FIGS. 6 and 12B). The connector body 260 also defines a terminal surface 272 that is spaced apart from a stop surface 276 of the hub 268 along the axial direction A a distance D3. The distance D3 is substantially equal to the distance D2. A free end 261 of the male conductive element 262 is disposed in a location downstream with respect to the terminal surface 272. The terminal surface 272 of the second electrical connector 226 is configured to abut the stop surface 168 of the first electrical connector 126 when the first and second mechanical connectors 36 and 78 are fully seated with respect to each other (see FIGS. 11B, and 12B).

The upstream tool 20 and downstream tool 60 as described above and illustrated in FIGS. 1-10 include upstream and downstream portions of the connection system 100. For instance, the upstream tool 20 includes the first modular connector 110 proximate the downstream end 22 and the downstream tool 60 includes the second modular connector 210 proximate its upstream end 64. In this manner, the upstream end 64 of the downstream tool 60 can be mechanically and electrically connected to the downstream end 22 of the upstream tool 20. It should be appreciated, however, that the upstream tool 20 also includes a modular connector that is similar to the illustrated second modular connector 210 shown in FIGS. 9A and 9B, located proximate is upstream end 24. Furthermore, the downstream tool 60 could include a modular connector similar to the illustrated first modular connector 110 shown in FIGS. 5A and 5B, located proximate its downstream end 62. In this manner, the upstream end 24 of the upstream tool 20 can be mechanically and electrically connected to an additional tool (e.g. a tool with a connection system 100 as described herein), and the downstream end 62 of the downstream tool 60 can also be mechanically and electrically connected to an additional tool (e.g. a tool with a portion of the connection system 100 as described herein). This allows multiple tools to be connected end-to-end utilizing the connection system 100 as described herein. Specifically, a first tool, a second tool, a third tool, etc., can be connected end-to-end as described herein. In still other embodiments, the locations of the connection modules can be reversed. For example, the first modular connector 110 illustrated in FIGS. 5A and 5B can be located at the upstream end 24 the upstream tool 20 and the second modular connector 210 illustrated in FIGS. 9A and 9B can located at the downstream end 62 of the downstream tool 60.

Turning to FIGS. 11A-12C, the connection system 100 provides for multiple connection phases for coupling upstream tool 20 to the downstream tool 60. The connection phases can include: A) an alignment phase illustrated in FIGS. 11A and 12A; B) an electrical contact engagement phase illustrated in FIGS. 11B and 12B; and C) a mechanical connection phase illustrated in FIGS. 11C and 12C. Drilling typically occurs after the mechanical connection phase is completed where the tools are threaded together at specified torque levels. The connection system 100 allows one or more sets of tools to be coupled together in variety of situations depending on the well plan, BHA design, or other constraints. For instance, an operator may elect to couple first and second tools 20 and 60 off-site from the drill string or rig platform. Thereafter, the coupled first and second tools 20 and 60, are referred to as a "tool assembly," may be added to the drill string during make-up. In addition, the first and second tools 20 and 60 can be coupled together during a make-up or breaking-out operations. For purposes of illustrating the present disclosure of the connection system 100, the description that follows refers to the situation of connecting first and second tools 20 and 60 together during make-up. It should be appreciated, however, that the present disclosure could be applied to contexts of connecting tools together other than during a make-up operation.

During a make-up operation, the downstream tool 60 is positioned relative to a borehole 2 of an earthen formation 3 (not shown). For example, control equipment may position the downstream tool 60 partially inside the borehole 2 at the surface (or above and aligned with borehole 2 and held in place by the rig and control equipment) and coupled to downhole equipment located in the bore hole 2. The drill string 6 is advanced until the upstream tool 20 is position to receive the downstream tool 60. In the embodiment shown in FIGS. 11A-12C, the upstream tool 20 includes the suspension unit 118, upstream electrical connector 126, and female conductive element 162. The downstream tool 60 includes the downstream modular connector 210, the second electrical connector 226, and male conductive element 262 disposed proximate the upstream end 64.

Figure 11A:
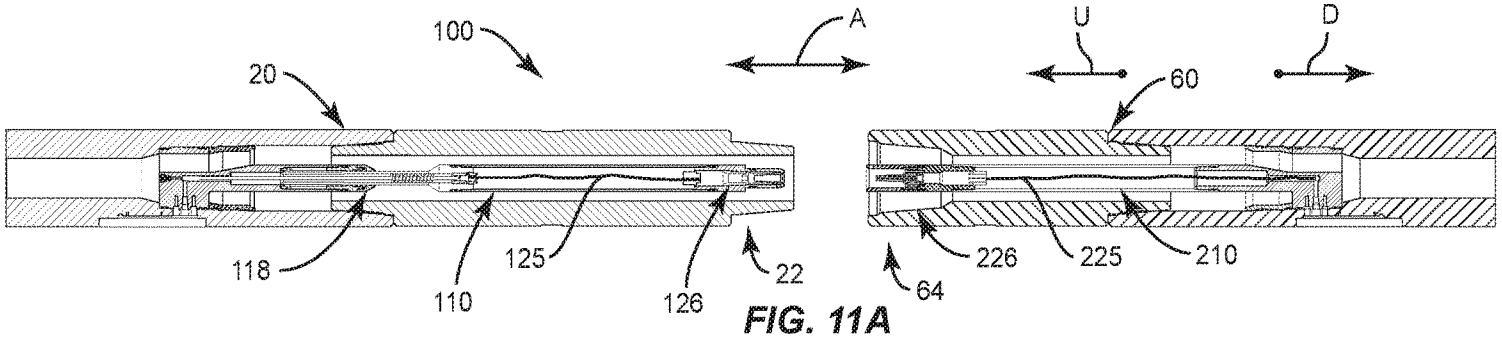
FIGS. 11A, 11B, and 11C are sectional views that illustrate phases for the connecting the first and second tools together with the connection system.
Figure 12A:
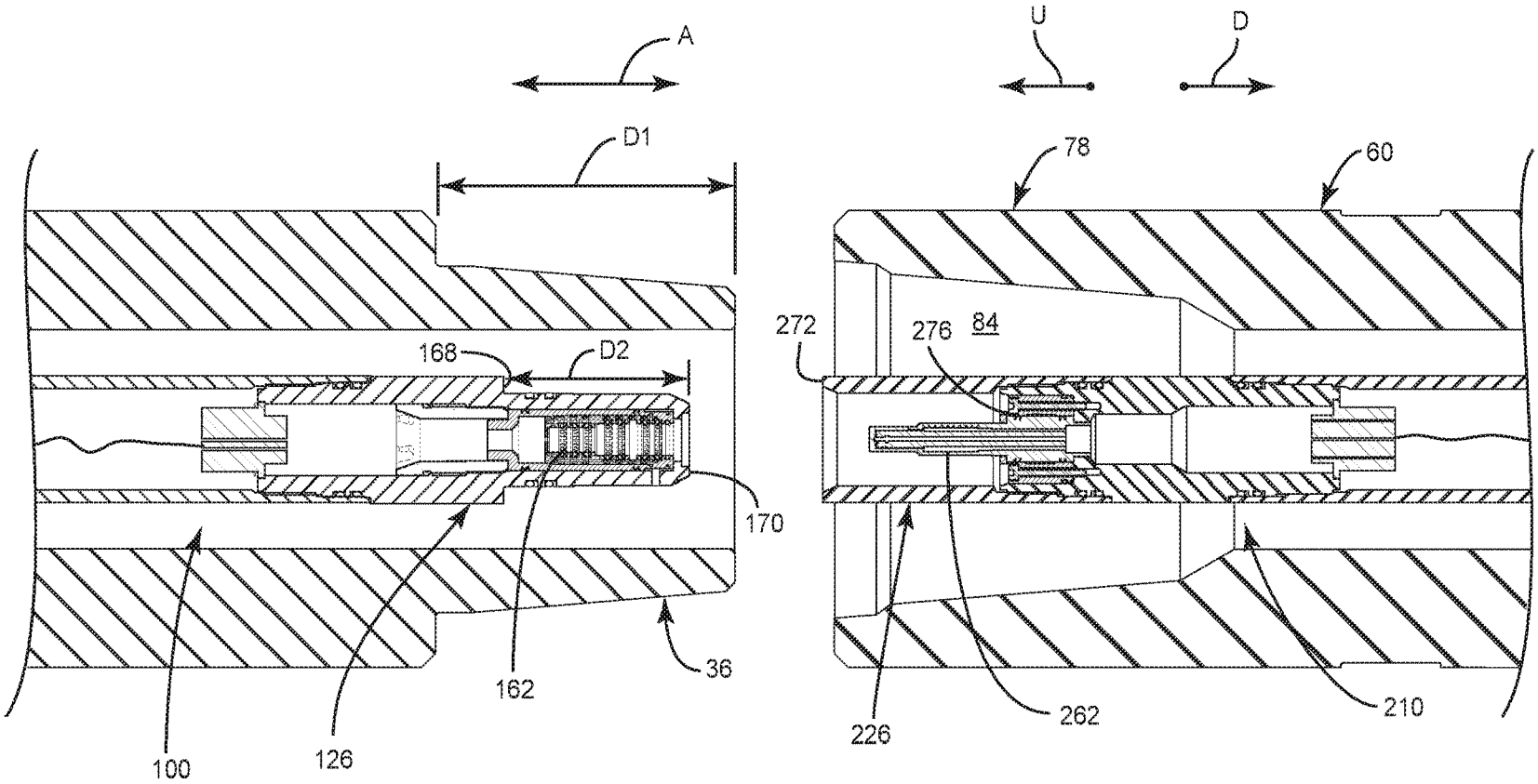
FIGS. 12A, 12B, and 12C are detailed sectional views of the mating ends of the first and second tools illustrated in FIGS. 11A, 11B, and 11C, respectively.

Referring to FIGS. 11A and 12A, during the alignment phase, the upstream tool 20 is aligned with the downstream tool 60 along the axial direction A. As illustrated, the upstream tool 20 and downstream tool 60 are aligned so that the cavity 84 of the mechanical connector 78 of the downstream tool 60 is an axially aligned with the mechanical connector 36 of the upstream tool 20. Furthermore, the second electrical connector 226 of downstream tool 60 is an axial alignment with the first electrical connector 126 of the upstream tool 20.

Figure 11B:
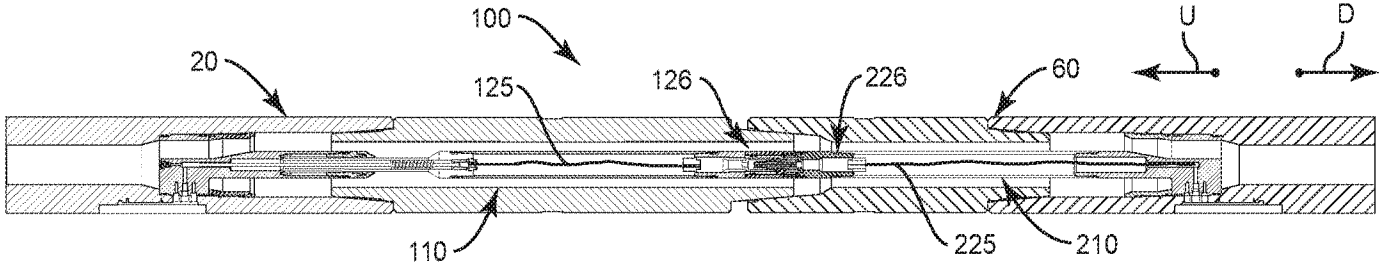
Figure 12B:
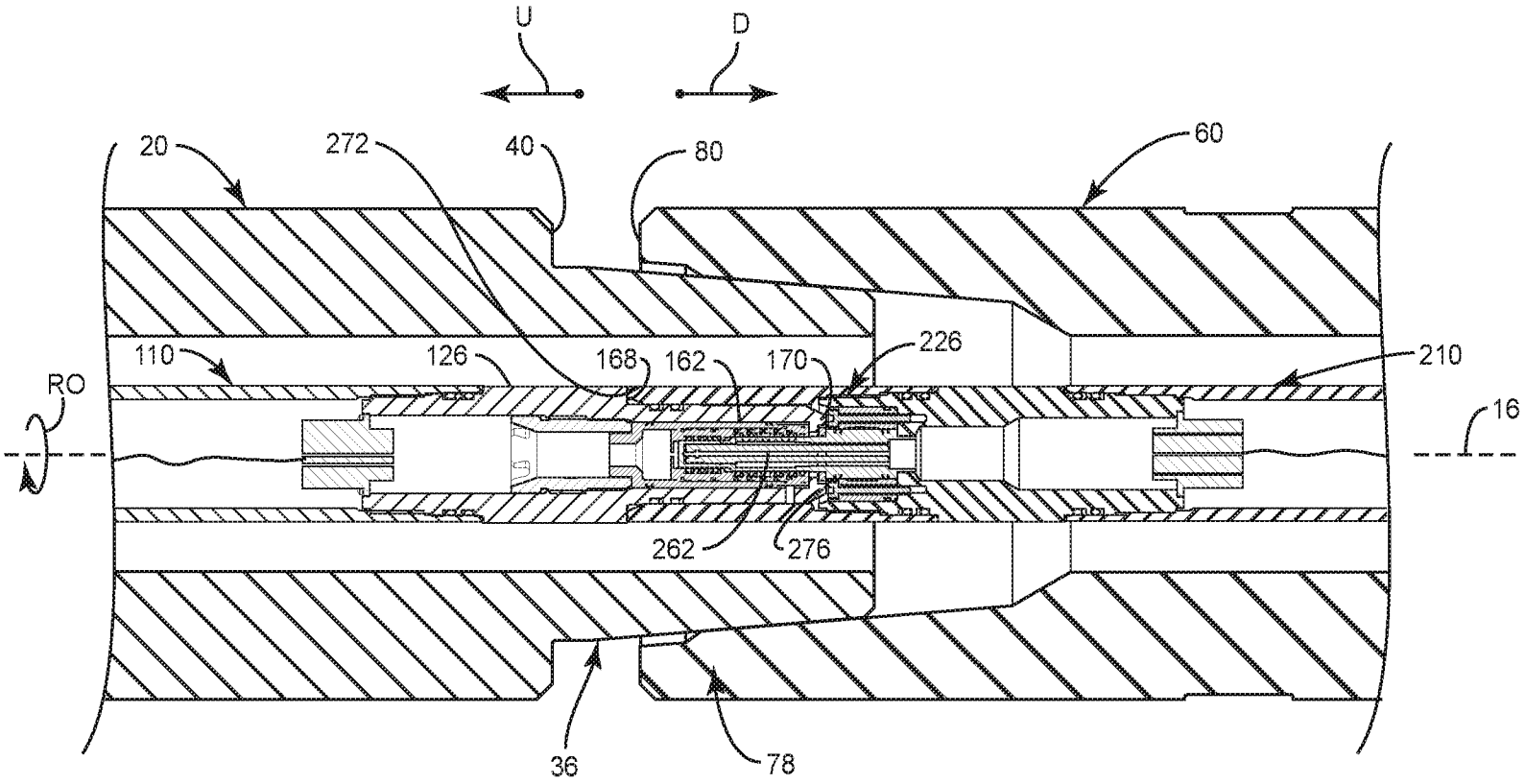

Turning to FIGS. 11B and 12B, during the electrical contact engagement phase, the upstream tool 20 is advanced into engagement with the downstream tool 60 in the downstream direction D. During this phase, the coupling surface 42 of the upstream tool 20 engages the coupling surface 82 of the downstream tool 60. The upstream tool 20 can be rotated about the central axis 16 in a rotational direction RO into threaded engagement with downstream tool 60. The rotational threaded engagement between the second mechanical connector 78 (of the tool 60) and the first mechanical connector 36 (tool 20) causes the upstream tool 20 to advance in the downhole direction D into further engagement with the downstream tool 60.

Continuing with FIGS. 11B and 12B, during the electrical contact engagement phase, the wall 166 of the first electrical connector 126 enters the annular void 269 while the male conductive element 262 enters the cylindrical path defined by the female conductive element 162 of the first electrical connector 126. The electrical conductive elements 162 and 262 are capable of rotational slidable contact with respect to each other, as well as axial slidable contact with each with respect to other, which facilitates coupling the first and second mechanical connectors 36 and 78 of the upstream tool 20 and downstream tool 60, respectively. The female conductive element 162 and male conductive element 262 are slidable with respect to each other along the axial direction A until the stop surface 168 of the first electrical connector 126 abuts terminal surface 272 of the second electrical connector 226, at which point further axial advancement of the male conductive element 262 with respect to the female conductive element 162 is inhibited. In this regard, as can be seen in FIG. 12B, the second electrical connector 226 is brought into contact with the first electrical connector 126. Further, during the electrical contact engagement phase, terminal surface 170 of the first electrical connector 126 abuts the stop surface 276 of the second electrical connector 226.

Figure 11C:
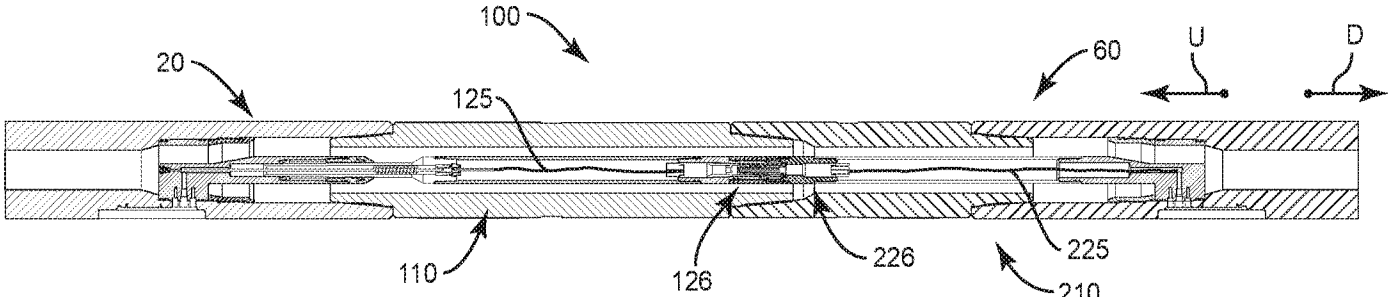
Figure 12C:
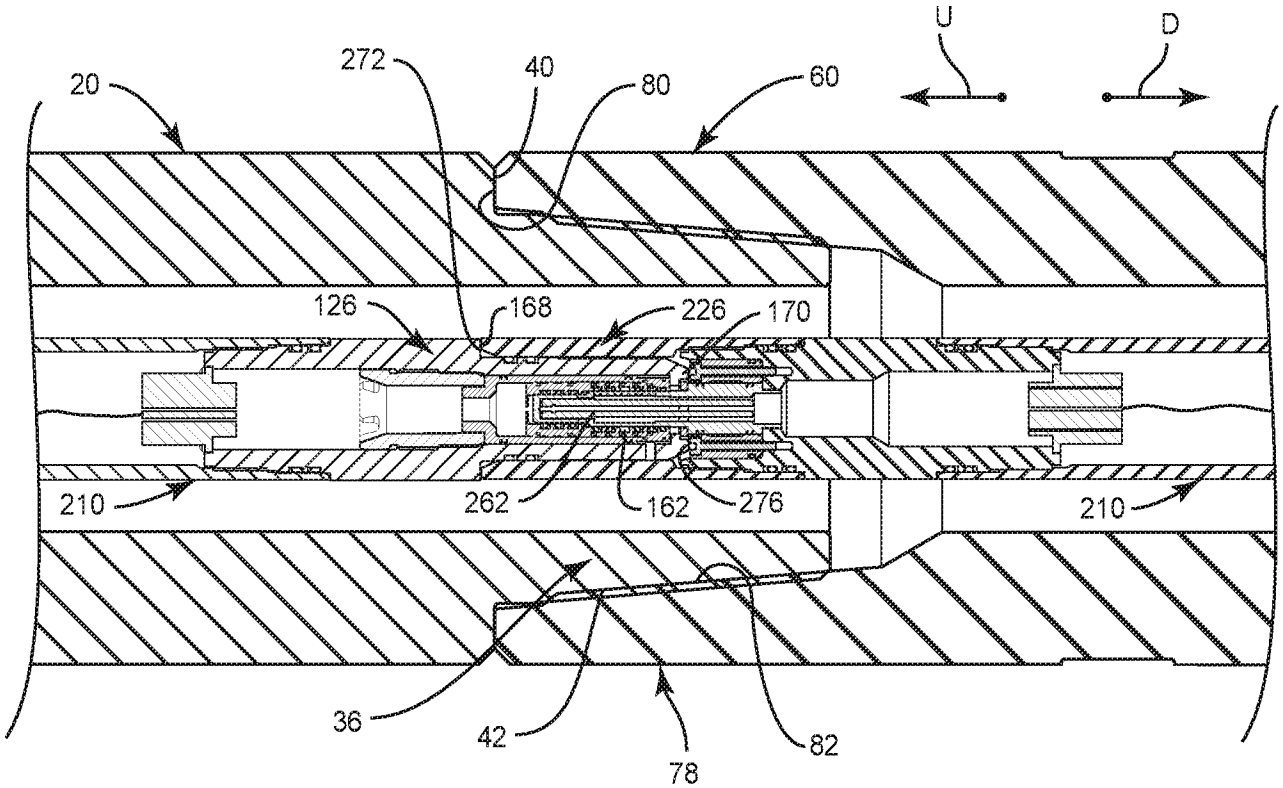

Turning to FIGS. 11C and 12C, the mechanical connection phase is illustrated. As can be seen in FIGS. 11C and 12C, further advancement of the upstream tool 20 along the downstream direction D mechanically couples the upstream and downstream tools 20 and 60 together. As the upstream tool 20 is threaded into place such that the coupling surfaces 42 and 82 are fully engaged, the first electrical connector 126 is urged in the uphole direction U with respect to downstream end 22 until the terminal surface 80 of the downstream tool 60 abuts the shoulder 40 of the upstream tool 20. In the mechanical connection phase, the suspension unit 118 biases the first electrical connector 126 in the uphole direction U against the upward force of the downstream tool 60 and second electrical connector 226 applied to the first electrical connector 126. This maintains an electrical connection between the female conductive element 162 and the male conductive element 262.

As discussed above, advancement of the upstream tool 20 in the downhole direction D includes rotating the upstream tool 20 relative to the downstream tool 60 such that the mechanical connector 36 of the upstream tool 20 is fully seated in the cavity 84 of the mechanical connector 78 of the downstream tool 60 and coupling surfaces 42 and 82 substantially overly. Because the distance D2 is less than the distance D1, the female conductive element 162 and male conductive elements 262 define an electrical contact, as shown in FIGS. 11B and 12B, before the upstream tool 20 is fully seated and fully threaded to the downstream tool 60, as shown in FIGS. 11C and 12C. Furthermore, the distance that the piston 138 could travel along the first modular connector 110 toward the feed-through centralizer 114 exceeds the distance of travel required for make-up of the upstream tool 20 to the downstream tool 60.

When the drilling operation is initiated, the operator can advance the mechanically and electrically coupled upstream and downstream tools 20 and 60 further into the borehole 2 and direct rotation of the drill bit and/or drill string as needed. The flow of drilling fluid through the internal passages of the upstream tool 20 along first modular connector 110 can increase the pressure along the first modular connector 110. Increased pressure in the drilling fluid along the suspension unit 118 effectively locks the first electrical connector 126 and the second electrical connector 226 together. As the connected upstream and downstream tools 20 and 60 advance further into the earthen formation, the pressure increases, further stabilizing the connection between the upstream and downstream tools 20 and 60.

The method could also include connecting an additional tool to an upstream end of the upstream tool 20 so as to define an electrical and mechanical connection between the additional tool and the upstream tool 20.

Furthermore, depending on the circumstances and condition of the mechanical connectors 36, 78 of either or both of the upstream and downstream tools 20, 60, the connection system 100 allows the length of the connection modules 110, 210 to be adjusted to accommodate variations in spacing between the mechanical connectors 36, 78 and the electrical connectors 126, 226 of the tools 20, 60. For instance, connection housing 150, 250 can be removed from the tools 20, 60 and cut to a specified length. The shortened connection housing150, 250 can be reassembled into the tools 20, 60 and the steps of connecting the tools 20, 60 together can proceed as described above.

It will be appreciated by those skilled in the art that various modifications and alterations of the present disclosure can be made without departing from the broad scope of the appended claims. Some of these have been discussed above and others will be apparent to those skilled in the art. The scope of the present disclosure is limited only by the claims.

We claim:

1. A tool system for a drilling operation, the tool system comprising:

a first tool elongate in an axial direction, the first tool having a first end, a second end spaced from first end along the axial direction, an internal passage that extends along the axial direction and that is configured to permit drilling fluid to pass therethrough, and a first mechanical connector disposed at one of the first and second ends;

a modular connector fixed to the first tool in the internal passage, the modular connector comprising a suspension unit and a first electrical connector that is coupled to the suspension unit, the suspension unit having a housing that defines a substantially sealed chamber filled with a gas, and a piston exposed to the gas in the substantially sealed chamber and movable with respect to the housing, the piston being coupled to the first electrical connector such that the first electrical connector is movable with respect to the first tool, a second tool having a first end, a second end opposed to the first end of the second tool, an internal passage that extends through the second tool, and a second mechanical connector disposed at one of the first and second ends of the second tool, the second mechanical connector adapted for engagement with the first mechanical connector of the first tool; and a second electrical connector supported in part by the second tool in the internal passage of the second tool, the second electrical connector being configured to mate with the first electrical connector so as to define an electrical contact between the first and second electrical connectors, wherein the movable piston is A) configured to permit the first electrical connector to move with respect to the first mechanical connector in a first direction that is aligned with the axial direction in response to a force applied to the first electrical connector, and B) responsive to a pressure differential between pressure in the substantially sealed chamber and pressure in the internal passage of the first tool to bias the first electrical connector in a second direction that is opposite the first direction.

2. The tool system of claim 1, wherein the second electrical connector includes at least one male conductive element or at least one female conductive element and the first electrical connector includes the other of the at least one male conductive element or the at least one female conductive element.

3. The tool system of claim 1, wherein the suspension unit is configured to bias the first electrical connector into mating engagement with the second electrical connector so as to maintain the electrical contact when the first and second mechanical connectors mechanically couple the first and second tools together.

4. The tool system of claim 1, wherein the suspension unit includes a shaft that is moveable along the axial direction in order to permit the first electrical connector to move along the axial direction in response to the force applied to the first electrical connector.

5. The tool system of claim 1, further comprising:

a feed-through centralizer coupled to the modular connector; and a threaded member that fixes the feed-through centralized to the first tool in the internal passage, such that that suspension unit is fixed to the first tool while the first electrical connector is movable relative the first tool.

6. The tool system of claim 1, wherein the modular connector includes a first connection housing that supports the first electrical connector and that is fixed to the piston, such that the first connection housing is moveable along with movement of the piston.

7. The tool system of claim 1, wherein the modular connector is a first modular connector, wherein the second tool includes a second modular connector that includes the second electrical connector, wherein the first and second modular connectors are configured to engage with each other so to define the electrical contact.

8. The tool system of claim 7, wherein the first modular connector includes a stop surface, and the second modular connector includes a terminal surface configured to abut the stop surface of the first modular connector when the first and second modular connectors are fully engaged with each other.

9. The tool system of claim 7, wherein the first mechanical connector defines a shoulder, a first terminal surface spaced from the shoulder a distance that extends from the shoulder to a plane defined by the terminal surface that is perpendicular to the axial direction, where the first modular connector defines a stop surface, a second terminal surface spaced from the stop surface along the axial direction, and a second distance that extends from the stop surface to a second plane that is aligned with the second terminal surface, wherein the second distance is less than the first distance.

10. The tool system of claim 9, wherein the second mechanical connector of the second tool defines a terminal surface such that the second tool terminates at the terminal surface, wherein the first electrical connector is adapted to move along the axial direction until the terminal surface of the second tool abuts the shoulder.

11. The tool system of claim 9, wherein the first tool is either a downstream tool or an upstream tool and the second tool is the other of the downstream tool and the upstream tool.

12. A tool, comprising:

a tool body that is elongate in an axial direction, the tool body having a first end, a second end spaced from the first end in the axial direction, a mechanical connector disposed at one of the first and second ends, and an internal passage that extends along the axial direction and that is configured to permit drilling fluid to pass therethrough;

a first modular connector in the internal passage and positioned toward the first end, the first modular connector comprising a suspension unit and a first electrical connector connected to the suspension unit, the suspension unit having a housing that defines a substantially sealed chamber filled with a gas, and a piston exposed to the gas in the substantially sealed chamber and movable with respect to the housing, the piston being coupled to the first electrical connector such that the first electrical connector is movable with respect to the tool body; and a second modular connector in the internal passage and positioned toward the second end, the second modular connector including a second electrical connector that is fixed relative to the second end, wherein the piston is A) configured to permit the first electrical connector to move with respect to the first mechanical connector in a first direction that is aligned with the axial direction in response to a force applied to the first electrical connector, and B) responsive to a pressure differential between pressure in the substantially sealed chamber and pressure in the internal passage of the first tool to bias the first electrical connector in a second direction that is opposite the first direction.

13. The tool of claim 12, wherein the first modular connector includes a first connection housing that supports the first electrical connector and that is fixed to the piston, such that, the first connection housing is moveable along with movement of the piston.

14. The tool of claim 12, further comprising a feed-through centralizer attached to the inner surface of the tool body, the feed-through centralizer supporting the first modular connector.

15. The tool of claim 12, wherein the first electrical connector includes an inner surface and at least one conductive element is supported by the inner surface.

16. The tool of claim 15, wherein the second electrical connector includes an inner surface and at least one conductive element supported by the inner surface of the second electrical connector.

17. The tool of claim 16, wherein the at least one conductive element of the first electrical connector is one of a) at least one female conductive element, and b) at least one a male conductive element, and the at least one conductive element of the second electrical connector is the other of the at least one female conductive element and the at least one male conductive element.

18. The tool of claim 17, wherein the at least one female conductive element is an annular ring and the at least one male conductive element is an elongate rod.

19. The tool of claim 18, wherein each female conductive element is a canted spring.

20. The tool of claim 12, wherein the second modular connector includes a second connection housing that is fixed to the tool body and that supports the second electrical connector.

21. A method, comprising:

positioning a downstream tool that is elongate in an axial direction relative to a borehole of an earthen formation, the downstream tool including a body, an internal passage that extends through the body, and a upstream electrical connector;

aligning an upstream tool with the downstream tool along the axial direction, the upstream tool including a body, an internal passage that extends through the body, and a downstream electrical connector, wherein either of the upstream tool or the downstream tool include a suspension unit in their respective internal passages, the suspension unit coupled to the respective electrical connector;

advancing the upstream tool into engagement with the downstream tool along a downstream direction such that the upstream electrical connector mates with the downstream electrical connector, thereby defining electrical contact between the upstream tool and the downstream tool;

causing the further advancement of the upstream tool along the downstream direction with respect to the downstream tool such that the either the upstream electrical connector or the downstream electrical connector moves along the axial direction until a stop surface of the upstream tool abuts a stop defined by the downstream tool and the upstream and downstream tools are mechanically coupled together;

advancing the mechanically coupled tools into the borehole; and causing drilling fluid to flow through the internal passages of the upstream tool and the downstream tool, such that a pressure differential between of the drilling fluid in the internal passage and a gas in suspension unit locks the upstream electrical connector and the downstream electrical connector together.

22. The method of claim 21, wherein the suspension unit defines a chamber filled with the gas and a piston exposed to the gas in the chamber, the piston operable to move relative to the chamber and supporting the downstream electrical connector, wherein the causing step causes the piston to move with respect to the chamber.

23. The method of claim 21, wherein the suspension unit includes a suspension housing, a mechanical biasing member, and a piston that is operable to move in the axial direction relative to the suspension housing, wherein the causing step causes the piston to move with respect to the suspension housing.

24. The method of claim 21, wherein the step of causing further advancement of the upstream tool includes threadably connecting the upstream tool to the downstream tool via threaded connectors.

25. The method of claim 21, further comprising the step of adjusting a length of the upstream modular connector prior to the advancing step.

26. The method of claim 21, further comprising the step of connecting an additional tool to an upstream end of the upstream tool such that the additional tool defines an electrical contact with the upstream tool.

27. A tool, comprising:

a tool body that is elongate in an axial direction, the tool body having a first end, a second end spaced from the first end in the axial direction, a mechanical connector disposed at one of the first and second ends, and an internal passage that extends along the axial direction and that is configured to permit drilling fluid to pass therethrough;

a first modular connector in the internal passage and positioned toward the first end, the first modular connector having:

a) a suspension unit, b) a first electrical connector connected to the suspension unit, c) a feed-through centralizer attached to the inner surface of the tool body, the feed-through centralizer supporting the suspension unit and the first modular connector, and d) a threaded member that fixes the feed-through centralized to the inner surface of the tool body in the internal passage such that that suspension unit is fixed to the tool body while the first electrical connector is movable relative the tool body, wherein the suspension unit is configured to permit the first electrical connector to move relative to the first end along the axial direction in response to force applied the first electrical connector in the axial direction; and a second modular connector in the internal passage and positioned toward the second end, the second modular connector including a second electrical connector that is fixed relative to the second end.

28. The tool of claim 27, wherein the suspension unit comprises:

a housing that defines a substantially sealed chamber filled with a gas, and a piston exposed to the gas in the substantially sealed chamber and movable with respect to the housing, the piston being coupled to the first electrical connector such that the first electrical connector is movable with respect to the tool body, wherein the piston is responsive to a pressure differential between pressure in the substantially sealed chamber and pressure in the internal passage of the first tool to bias the first electrical connector in a second direction that is opposite the first direction.

29. The tool of claim 28, wherein the first modular connector includes a first connection housing that supports the first electrical connector and that is fixed to the piston, such that, the first connection housing is moveable along with movement of the piston.

30. The tool of claim 27, wherein the first electrical connector is one of a) at least one female conductive element, and b) at least one a male conductive element, and tthe second electrical connector is the other of the at least one female conductive element and the at least one male conductive element.

* * * * *